United States Patent [19]

Arioli et al.

[11] 3,967,473

[45] July 6, 1976

[54] EQUIPMENT FOR SELECTIVE STEAM TREATMENT OF CONTINUOUS FABRIC PIECES

[76] Inventors: Roberto Arioli, 15, via Cristoforo Colombo; Ameda Arioli; Lorenza Arioli, both of 20, via Cristoforo Colombo, all of Gerenzano, Varese; Carlo Rezzonica, 7, via Manetti, Saronno, Varese, all of Italy

[22] Filed: Apr. 17, 1974

[21] Appl. No.: 461,736

[30] Foreign Application Priority Data

Apr. 20, 1973 Italy ..... 23294/73

[52] U.S. Cl. ..... 68/5 D

[51] Int. Cl.[2] ..... D06B 3/12

[58] Field of Search ..... 68/5 C, 5 D, 5 E; 34/155, 157, 159

[56] References Cited

UNITED STATES PATENTS

| | | | |
|---|---|---|---|
| 1,564,565 | 12/1925 | Harris | 34/157 X |
| 2,290,053 | 7/1942 | Hurxthal | 34/157 |
| 3,603,119 | 9/1971 | Kawaguchi | 68/5 D |
| 3,769,817 | 11/1973 | Roach | 68/5 D |
| 3,838,968 | 10/1974 | Fleissner | 68/5 D X |

FOREIGN PATENTS OR APPLICATIONS

| | | | |
|---|---|---|---|
| 11,368 | 9/1885 | United Kingdom | 68/5 D |

*Primary Examiner*—Philip R. Coe
*Attorney, Agent, or Firm*—Michael J. Striker

[57] ABSTRACT

An arrangement, for continuously steam treating pieces of fabric for dye development and fixing or for other steam treatments selectively requiring processing the fabric with saturated or with differently overheated steam, includes an open bottomed chamber having double-walled side and roof walls defining interior spaces. The lower region of the spaces is supplied with and contains a quantity of demineralized water. Heat exchange coils which are operative by circulating diathermic oil therein are immersed in the water for boiling the same and generating saturated steam. Selectively heatable additional coils are arranged in other regions of the spaces for selectively overheating the steam. Openings are provided at the top of the chamber for downwardly issuing saturated or overheated steam thereinto and means are provided for recycling the steam at an elevation above the plane defined by the open bottom of the chamber. Means are provided for continuously progressing fabrics through the steam filled environment.

9 Claims, 5 Drawing Figures

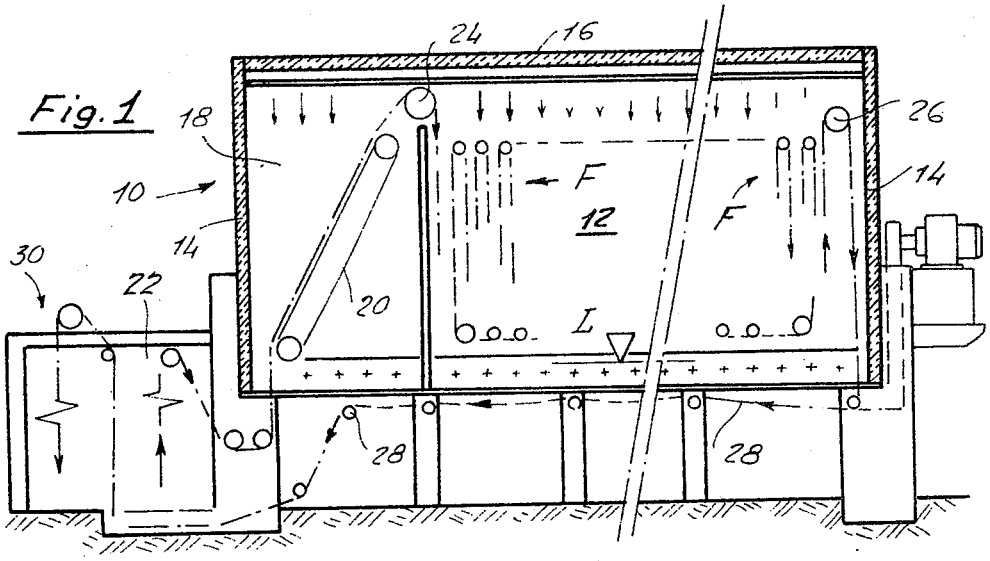
Fig. 1
24
16
18
26
10
14
F
12
F
14
30
22
20
L
28
28
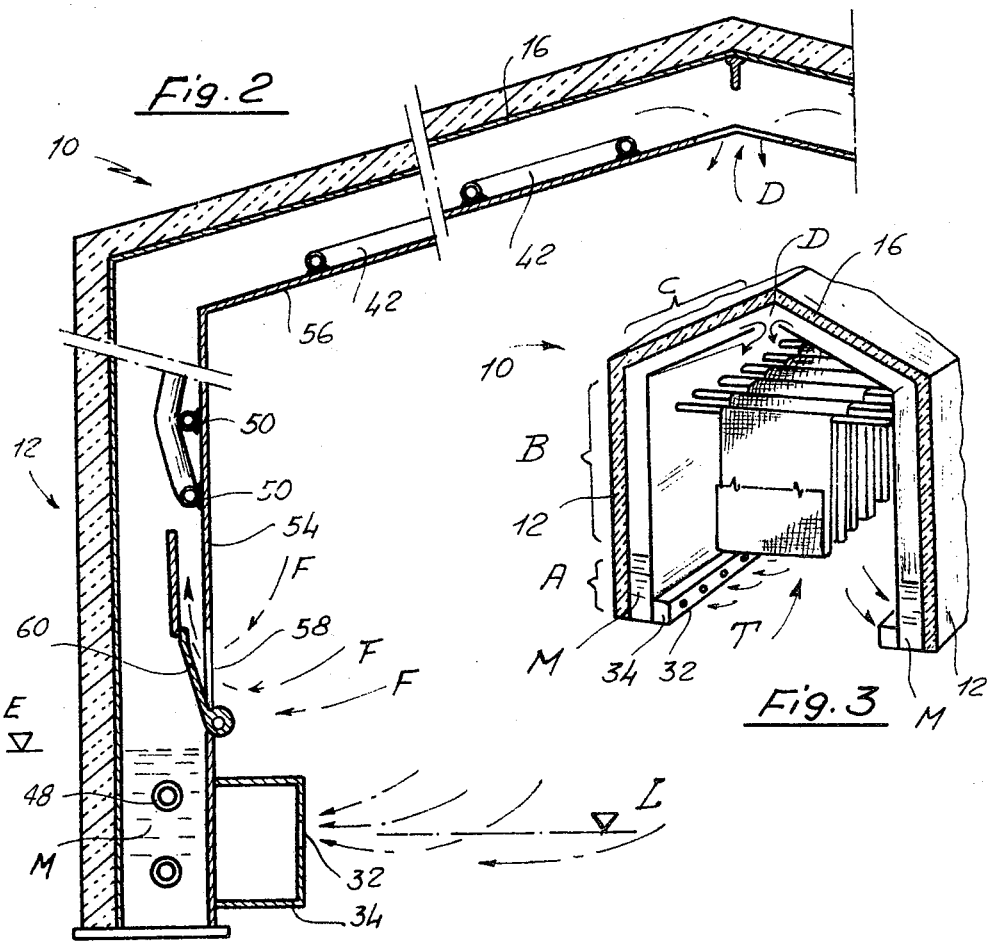
Fig. 2
16
10
D
42
42
56
50
50
54
12
F
58
60
F
F
E
48
M
32
34
L
D
16
C
10
B
12
A
M
34
32
T
12
M
Fig. 3

EQUIPMENT FOR SELECTIVE STEAM TREATMENT OF CONTINUOUS FABRIC PIECES

BACKGROUND OF THE INVENTION

This invention relates generally to an arrangement for the steam treatment of printed fabrics in order to develop and fasten dyes applied on said printed fabrics during the printing process.

This invention relates particularly to an arrangement for selectively carrying out the steam treatment either with saturated or with overheated steam on printed fabrics, depending upon the particular requirements required in the different treatment cases. These steam treatments, as is well known in the art, may be carried out in the case of fully saturated steam, at atmospheric pressure and at temperatures at condensation limits, on the order of 97° -99°C. In the case of fully overheated steam, the operational temperatures are higher and range up to temperature ranges of 180° and still higher temperatures. The higher temperatures require intermediate needs and other conditions may be encountered. The invention gives a user the option of steam treatments and provides maximum selectivity as required.

SUMMARY OF THE INVENTION

The invention comprises a chamber having hermetically closed side and upper walls and an open lower region at the plane defined by the lower edges of the front and side walls. It further includes means for continuously introducing a continuous piece or ribbon of fabric into said chamber through its said lower region, means for feeding the fabric into a steam environment so that said fabric remains in contact with the steam as long as required for the treatment, and means for removing the fabric from the feeding means via the lower region of the chamber.

The invention also includes means for generating steam and issuing it from the upper portion of said chamber, in either the required saturation or overheating condition, so that the steam is forced to progressively and uniformly flow down into the interior space defined by the chamber. The steam flow removes therefrom all of the originally present atmospheric air and maintains an atmosphere consisting entirely of steam.

An essential object of this invention is to permit the execution of operations in the widest treatment range, and still maintain high quality and quantity performance. In particular, the steam equipment of this invention permits the execution of other heat treatment operations besides the aforementioned development and fastening of dyes. It is possible to use the equipment for obtaining the free shrinkage of synthetic, artificial, natural or mixed fibers; or for obtaining, for example, complementary purgation treatments, in steam only. The purgation treatments ensure the obtaining of the maximum swelling effect and, hence, the most favourable penetration of the fibers by the different chemicals, such as solvents, soaps, bleaching agents and others.

Furthermore, the steam equipment of this invention permits the fabrics to be treated with steam generated in saturated condition in the equipment itself from essentially demineralized water. This feature releases the equipment from the well known drawback of having to separately supply saturated steam by boilers or overheaters operating at strongly superatmospheric pressures; thereby avoiding the known degenerative phenomena which notoriously result from intense preliminary steam overheatings.

According to an essential feature of the steam equipment according to the present invention, the steam is formed directly within a treatment chamber by boiling a mass of water arranged and maintained at a lower region of a hollow space formed intermediate double-wall side components of the walls of said chamber.

This feature, among other things, an impurity-free demineralized mass of water to be used in steam treating a fabric; this pollution-free steam is of great importance inasmuch as the chemical composition of the steam has been proven to be of determinative significance for the general purposes of steams treatments, and particularly for dye fixing operations. The absence of minerals or salts from the water eliminates the possibility of undesirable chemical reactions developing with the agents existing on the fabric.

The complete heating of said mass of water ensures its complete saturation and removes the danger that the steam will not be fully saturated even after whose crossing of a layer of water at the surface unsaturated steam bubbles may be released.

According to a complementary feature of the invention, said mass of water is brought to boiling by means of heat released by a coil arranged in the space occupied by said mass of water. Within the coil, a thermal vehicle, consisting preferably of a liquid having a considerable thermal mass, is circulated. Preferably, thermal vehicle diathermic oil is utilized, said coil cooperates with well known thermostatically controlled heating means. Further independently fed and/or controlled anti-condensation coils are disposed in a hollow space formed within the walls which form the roof of the chamber so as to avoid premature condensation phenomena.

According to another advantageous feature of the invention, complemental and similarly independently fed or controlled overheating coils are disposed in the hollow space existing in the double side walls of the chamber upstream of the anticondensation coils. The feeding of said overheating coils may be selectively carried out to obtain retention of the steam flowing up along the hollow spaces under the required heat service conditions.

In this case, the steam generated at the lower region of said hollow space is overheated during its upward motion along said hollow space; at the same time, the chamber inner walls, are heated at the overheating temperature and ensure the heat homogeneity of the entire vaporization environment with the absence of any convection motion, which might alter said homogeneity and the full saturation of the chamber with steam only.

These and further features of the invention and the resulting advantages will be better understood from the following detailed description of a preferred embodiment of the improved equipment, taken in conjunction with the accompanying drawings.

THE VIEWS OF THE DRAWINGS

FIG. 1 is a sectional view in small scale and with several simplifications in its structural details of the preferred embodiment through its vertical longitudinal symmetry plane;

FIG. 2 is a fragmentary cross-sectional view of the preferred embodiment of FIG. 1;

FIG. 3 is a fragmentary perspective cross-sectional view illustrating some critical and essential parts.

DETAILED DESCRIPTION OF THE PREFERRED EMBODIMENT

Figure 4:
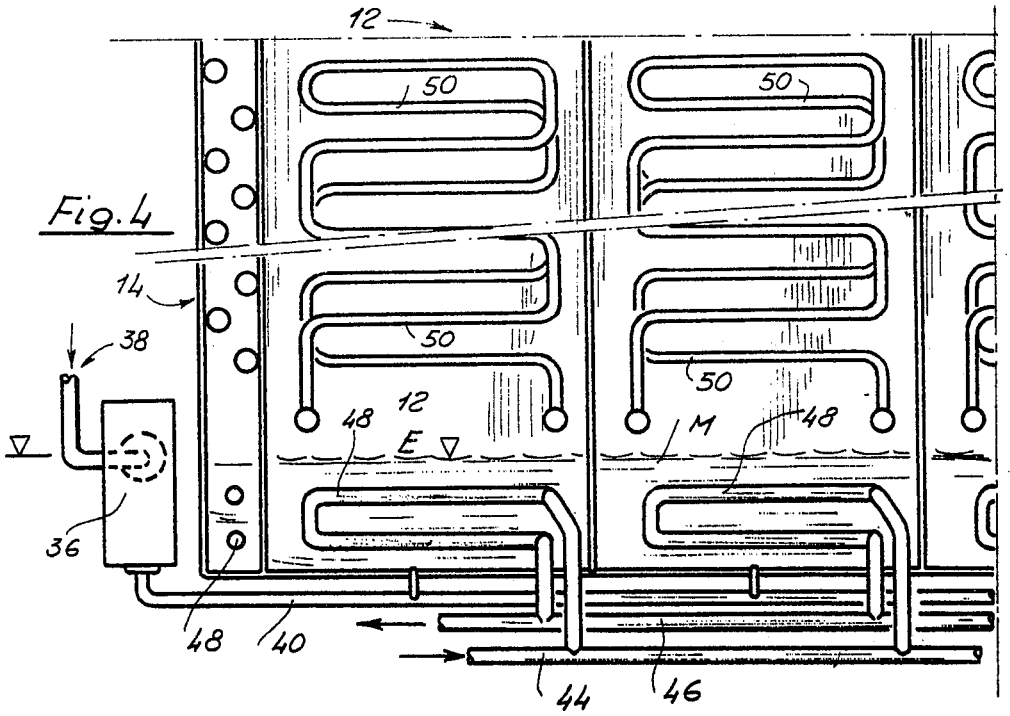
FIGS. 4 and 5 illustrate heat exchange means arranged in the hollow spaces of the side walls and the upper wall or roof of the treatment chamber, respectively.

Generally and as exemplified in FIG. 1, the new equipment includes a chamber 10 having wall means including side walls 12, front walls 14 and covering or roof walls 16; the wall means are of double walled configuration and are externally insulated so as to avoid heat dissipation and to ensure above all the homogeneity of the thermal level.

Preferably, the covering wall 16 is built as a V-shaped roof with symmetrical downwardly sloping walls so as to ensure that eventual condensation drops will slidably flow to the sides of said chamber without falling onto fabric T (FIG. 3) which is being treated therein.

Preferably, the fore portion 18 of the chamber 10 or bell provides a pre-treatment chamber in which a belt conveyor 20 receives the fabric from a feed apparatus 22 and vertically conveys the fabric to be entrained about a feed roller 24. The fabric then descends towards the belt sets in laps F which are being progressively and slowly moved forward along the chamber for the time period required for the steam treatment, as will be described below. At the end of this time period, the fabric is picked up again by a return roller or cylinder 26 and suitably supported by additional rollers 28 and is thereupon returned underneath the chamber 10 into a pickup and collecting unit 30.

Inside said chamber there is either generated or maintained, an atmosphere which consists exclusively of steam. The steam atmosphere fills up the entire chamber until at a level L, which is adjacent to an open lower portion of the chamber, the steam exits via suction means via suitable openings 32 which are provided along the elongation of the ducts 34. The ducts 24 are preferably of stainless steel and extend along the base and the inner perimeter of the chamber itself. The suction force is generated by conventional means and preferably by a suitable centrifugal fan (not shown).

The pre-treatment chamber 18, in which the gaseous atmosphere is constituted of saturated steam, imparts a high degree of humidity to the fabric itself. The humidity is essential to the fastening process and is imparted before said fabric is conveyed to the downstream subsequent chamber where it undergoes a high temperature treatment.

By using a continuous belt conveyor 20 for the travel and lifting of the fabric in the pre-treatment chamber 18 tension on the fabric itself is avoided, despite the fact that the fabric is lifted to a rather high elevation. The conveyor 20 thereby avoids any rolling of the selvage of the fabric, and particularly for knitted fabrics, and thereby further avoids any danger of staining the fabric with dye.

As diagrammatically shown in FIG. 3, the side double walls 12 (and possibly the front walls 14) and the upper wall 16 of the treatment chamber 10 may be divided into separate zones having different functions. In the lower zone A of the hollow space formed by side walls 12 steam is generated by boiling a mass of water M arranged and maintained therein at a suitable level E; for example, by means of a well known pump device 36 (FIG. 4) for constant level feed. The device 36 is connected to a suitable source 38 of filtered and demineralized water and communicates through suitable pipes 40 and connectors with the different sections into which the bottom of the hollow space as divided.

The overlying zone B of the vertical walls 12 serves principally to guide the passage of the flow, generated in the underlying zone A, upwardly in the chamber and towards the zone C. Zone C is formed by the roof walls 16 and guides the flow; towards the summit of the chamber, whereat the passages D are arranged for admitting the steam in the treatment chamber and eventual pre-treatment chamber 18.

In zone C, there are disposed heating means of coils 42, wherein heated diathermic oil is circulated for maintaining the roof of the chamber at a suitable temperature such as to avoid premature steam condensation. In the case of overheated steam being available due to the presence of a pre-existing steam generating system in the factory, this overheated steam may be fed into said hollow space for high temperature treatment. According to a preferred embodiment of the invention, the equipment is complemented with a suitable conventional diathermic oil (or other equivalent liquid thermal vehicle) heater (not shown) which is connected via delivery and return pipes 44 and 46, respectively, (FIG. 4) to auxiliary heating means or coils 48. Coils 48 are respectively arranged in the lower zones A of the hollow space, and are immersed into the mass of water M. By operating with a liquid thermal vehicle, such as diathermic oil, the temperature and the delivery of this oil in said coils may be adjusted with maximum accuracy, thus presetting precisely the quantity of saturated steam generated in the zone A. For the execution of high temperature treatment, the saturated steam is overheated in the course of its travel through the overlying zones B of said hollow space. In zones B there are arranged overheating coils 50 being, in turn, operative by diathermic oil (or an equivalent liquid agent) at a temperature exceeding the overheating temperature.

It is, therefore, apparent that the overheating of the steam occurs at room pressure and without appreciable successive expansion phenomena. The overheating treatment is carried out at the temperature at which the steam has to operate on the fabric, thereby avoiding the well known inconveniences resulting from the excessive overheatings preceding the strong expansions occurring in the conventional apparatuses being supplied by steam-producing external boilers and overheaters.

These overheating coils 50, extending adjacent, as exemplified in FIG. 2, along the inner walls 54 of the chamber (and similarly the anti-condensation coils 42 in the roof 16 extend adjacent along the inner wall 56 of the latter) also perform the important task of maintaining said walls 54, 56 at a temperature equal, substantially equal or at least to the treatment temperature, thereby obtaining the desired thermal homogeneity of the steam atmosphere at each point of the elevation of the chamber.

Figure 5:
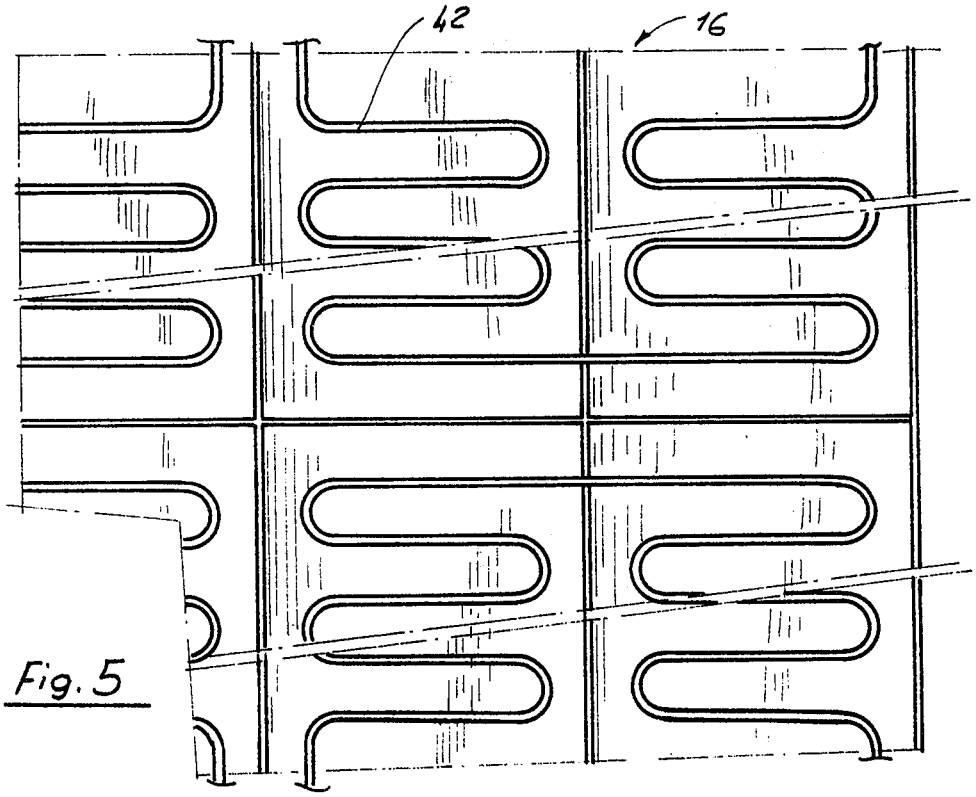

Obviously and as exemplified in FIGS. 4 and 5, the different coils are suitably split into individually controlled and fed sections in order to take into account their different heat service functions.

In operation, the steam flowing progressively down from the passage D reaches the level L and is sucked in through the passages 32 and the duct 34 and is eventually discharged to the outside. Alternatively, the steam may be condensed and re-used (by prior filtering of the condensation water, which may contain solvents or other chemical agents removed from the fabric) and readmitted into the zone A of the hollow space. In this latter approach, at least a portion of the thermal energy previously imparted to the steam for its heating up to the boiling temperature may be recaptured and re-used; thus avoiding unnecessary wasting of energy.

Since in the treatment environment of the equipment, steam exists exclusively above the level L, it is possible in some cases to repeatedly recirculate a portion of the steam in said chamber. This recirculation thereby obtains an appreciable saving of the thermal energy required for the conversion of water to steam; for example, by providing the inner walls 54 with openings 58 (FIG. 2) which are adapted to be opened by displacement of the hatches 60. The hatches 60 are oriented so as to direct the steam entering from the inside of the chamber, as indicated by arrows F in the FIG. 2, upwardly towards Zone C. The recycled steam will mix with the steam generated in the underlying zone A of the hollow space, and will be still subject to the thermal conditions determined by the coils 50 and 42.

We claim:

1. Apparatus for steam-treating fabrics, particularly continuous printed fabrics, comprising a steamer housing having a treatment chamber including a pair of spaced upstanding side walls, an open bottom portion and an upper wall extending intermediate with and connected to said side walls so as to close the upper region of said chamber, said side and upper walls respectively comprising a double-walled inner and outer wall portion defining an interior passage therebetween; a steam inlet at the uppermost point of said housing located on said upper wall and communicating with said chamber; means for generating steam at a first saturated temperature and for admitting said steam in a flow path in said interior passage towards said steam inlet so that the steam entering said chamber via said inlet expels any atmospheric air therein and provides a steam-treating environment substantially containing steam, said steam-generating means disposed adjacent said open bottom portion and having at least one heating coil having a heat-conducting interior portion, said coil being immersed in a leveled quantity of water and being operative to evaporate said water by passing a heated fluid having thermal energy corresponding to said first saturated temperature through said heat-conducting interior portion, said one heating coil having diathermic oil in its heat-conducting interior portion for producing saturated steam and being located in the part of said interior passage defined by said side walls; means for admitting a continuous fabric to be steamed into said chamber and for removing said steamed fabric through said open bottom portion; anti-condensation means for heating said steam in the part of said interior passage defined by said upper wall intermediate said steam inlet and said steam-generating means and for preventing condensation of said steam; means intermediate said steam-generating means and said steam inlet for selectively heating said saturated steam to a second over-heated temperature higher than said first temperature to permit the steam-treating of the fabric at different temperatures at the option of a user; and means for recirculating said steam from the inside of said chamber into said interior passage, said recirculating means comprising at least one opening formed in the inner wall portion of said side walls intermediate said steam-generating means for selectively and adjustably closing said opening.

2. Apparatus for steam-treating fabrics, particularly continuous printed fabrics, comprising a steamer housing having a treatment chamber including a pair of spaced upstanding side walls, an open bottom portion and an upper wall extending intermediate with and connected to said side walls so as to close the upper region of said chamber, said upper wall comprising a pair of V-shaped inclined wall portions which converge upwardly towards said upper region, said side and upper walls respectively comprising a double-walled inner and outer wall portion defining an interior passage therebetween; a steam inlet centrally located on said upper wall at the point of convergence of said inclined wall portions so as to permit steam condensate droplets forming on said inner wall portion of said upper wall to slide downwardly towards said side walls, said steam inlet communicating with said chamber; means for generating steam at a first saturated temperature and for admitting said steam in a flow path in said interior passage towards said steam inlet so that the steam entering said chamber via said inlet expels any atmospheric air therein and provides a steam-treating environment substantially containing steam, said steam-generating means disposed adjacent said open bottom portion and having at least one heating coil having a heat-conducting interior portion, said coil being immersed in a leveled quantity of water and being operative to evaporate said water by passing a heated fluid having thermal energy corresponding to said first saturated temperature through said heat-conducting interior portion, said one heating coil having diathermic oil in its heat-conducting interior portion for producing saturated steam and being located in the part of said interior passage defined by said side walls; means for admitting a continuous fabric to be steamed into said chamber and for removng said steamed fabric through said open bottom portion; anti-condensation means for heating said steam in the part of said interior passage defined by said upper wall intermediate said steam inlet and said steam-generating means and for preventing condensation of said steam; and means intermediate said steam-generating means and said steam inlet for selectively heating said saturated steam to a second over-heated temperature higher than said first temperature to permit the steam-treating of the fabric at different temperatures at the option of a user.

3. Apparatus for steam-treating fabrics, particularly printed fabrics, comprising a steamer housing having a treatment chamber including a pair of spaced upstanding side walls, an open bottom portion, and an upper wall having a steam inlet communicating with said chamber, said side and upper walls respectively comprising an inner and an outer wall portion bounding an interior passage therebetween for guiding steam in a flow path towards said inlet and into said chamber; means for conveying a fabric to be steamed through said chamber; means for generating steam in said path at a first saturated temperature; means intermediate said steam-generating means and said steam inlet for selectively heating said saturated steam to a second overheated temperature higher than said first temperature to permit the steam-treating of the fabric at different temperatures at the option of a user; and means for recirculating the steam from the inside of said chamber into said interior passage, said recirculating means including at least one opening formed in the inner wall portion of said side walls intermediate said steam-generating means and said steam inlet, and hatch means for selectively and adjustably closing said opening.

4. Apparatus for steam-treating fabrics, particularly printed fabrics, comprising a steamer housing having a treatment chamber including a pair of spaced upstanding side walls, an open bottom portion, and an upper wall comprising a pair of V-shaped inclined wall portions which converge in direction away from said bottom portion; a steam inlet communicating with said chamber and being centrally located at the point of convergence of said inclined wall portions of said upper wall; means for conveying a fabric to be steamed through said chamber; means for generating steam at a first saturated temperature and for admitting the steam in a flow path towards said inlet and into said chamber so that any steam condensate droplets which are formed on said inclined wall portions of said upper wall slide downwardly towards said side walls; and means intermediate said steam-generating means and said steam inlet for selectively heating said saturated steam to a second over-heated temperature higher than said first temperature to permit the steam-treating of the fabric at different temperatures at the option of a user.

5. An apparatus as defined in claim 3, wherein said steam-generating means comprises at least one heating coil having a heat-conducting interior portion, said one coil being immersed in a quantity of water and being operative to evaporate said water by passing a heated fluid having thermal energy corresponding to said first saturated temperature through said heat-conducting interior portion.

6. An apparatus as defined in claim 5, wherein said one heating coil has diathermic oil in said heat-conducting portion for producing saturated steam and is located in the part of said interior passage defined by said side walls; and further comprising anti-condensation means for heating said steam in the part of said interior passage defined by said upper wall intermediate said steam inlet and said steam-generating means and for preventing condensation of the steam.

7. An apparatus as defined in claim 6, wherein said anit-condensation means comprises at least one heating coil having a heat-conducting interior portion, said coil of said anti-condensation means being operative to prevent condensation of said steam by passing a heated fluid through its interior portion.

8. An apparatus as defined in claim 1, wherein said means for heating said saturated steam to a second temperature and said anti-condensation means are respectively in thermal contact with said inner wall portion of said side and upper walls of said chamber so that the interior thereof is maintained at a constant temperature.

9. An apparatus as defined in claim 2, and further comprising means for recirculating said steam from the inside of said chamber into said interior passage.

* * * * *